United States Patent [19]

Budde et al.

[11] Patent Number: 4,955,348

[45] Date of Patent: Sep. 11, 1990

[54] FUEL INJECTION CONVERSION SYSTEM FOR V-TWIN MOTORCYCLE ENGINES

[75] Inventors: William A. Budde, 1128 Gilbert St., Hayward, Calif. 94541; Floyd Khapp, Mountain View, Calif.

[73] Assignee: William A. Budde, Hayward, Calif.

[21] Appl. No.: 434,436

[22] Filed: Nov. 8, 1989

[51] Int. Cl.[5] ..... F02D 41/24; F02D 41/02

[52] U.S. Cl. ..... 123/478; 123/73 C; 123/416

[58] Field of Search ..... 123/73 AD, 73 C, 52 M, 123/339, 415, 416, 417, 472, 478, 480, 479, 514

[56] References Cited

U.S. PATENT DOCUMENTS

| | | | |
|---|---|---|---|
| 4,149,496 | 4/1979 | Palma | 123/472 X |
| 4,180,023 | 12/1979 | Kobayashi et al. | 123/478 |
| 4,290,394 | 9/1981 | Frank et al. | 123/73 C X |
| 4,341,193 | 7/1982 | Bowler | 123/472 |
| 4,347,823 | 9/1982 | Kessler et al. | 123/472 |
| 4,446,833 | 5/1984 | Matsushita et al. | 123/73 C X |
| 4,473,051 | 9/1984 | Chorman | 123/472 X |
| 4,492,913 | 1/1985 | Arnold et al. | 123/472 X |
| 4,524,745 | 6/1985 | Tominari et al. | 123/478 |
| 4,546,746 | 10/1985 | Sato et al. | 123/472 X |
| 4,805,571 | 2/1989 | Humphrey | 123/73 C X |

*Primary Examiner*—Willis R. Wolfe

*Attorney, Agent, or Firm*—Bruce & McCoy

[57] ABSTRACT

A conversion kit for V-twin motorcycles to convert them from carbureted to fuel injection.

13 Claims, 7 Drawing Sheets

FUEL INJECTION CONVERSION SYSTEM FOR V-TWIN MOTORCYCLE ENGINES

BACKGROUND OF THE INVENTION

1. Field of the Invention

The present invention relates to fuel injection systems for reciprocating engines and more particularly to a fuel injection conversion system for V-twin motorcycle engines and specifically to convert carbureted Harley-Davidson motorcycles to fuel injection.

2. Description of the Prior Art

For a long time it has been recognized that fuel injection is a more efficient way in which to provide the fuel air mixture to a reciprocating engine. In the past, however, fuel injection has been difficult to utilize for the reason that it requires a very sophisticated sensing system in order to be able to accurately determine how much fuel should be provided for each stroke of each cylinder of the reciprocating engine. In the last few years, reliable and accurate sensing systems have been developed, and fuel injection is regularly utilized for providing the fuel air mixture to reciprocating engines. There are two means by which this can be done. One way is to inject the fuel directly into the cylinder where it is mixed with the inletted air as the air enters into the cylinder; the other way is to inject the fuel portion into the air flow as it is inletted into the cylinder whereby it is premixed both outside of the cylinder as well as by the turbulence caused while it enters the cylinders with the inletted air.

The problem of retrofitting a fuel injection system onto an engine which was originally designed for carburetion is a substantial one. However, the added benefit of fuel injection in providing greater volumetric efficiency to the engine has required those attempting to make such conversions to overcome the numerous problems and to make several elections regarding the method by which the fuel injection will be accomplished.

The present invention involves a series of selections to provide the proper combination of alternatives to adapt fuel injection to V-twin motorcycle engines as well as providing a unique apparatus and means by which the conversion for these particular engines from several very different model designs can be accomplished. It avoids numerous problems involved in such a conversion and utilizes a simplified arrangement and mode of operation to effect the result with a universal apparatus for the various model designs.

SUMMARY OF THE INVENTION

The present invention is a fuel injection conversion system for V-twin motorcycle engines having two cylinders, an ignition system, and a fuel source. The conversion includes an intake manifold providing separate ducts for delivering a fuel and air mixture separately to each cylinder. A pair of fuel injectors are mounted in a fuel injector throttle body secured to the intake manifold for mixing fuel from the injectors with air being drawn into the engine cylinders through the intake manifold. A fuel distributor is provided for delivering an individual pressurized fuel flow to each of the injectors. A fuel pump is provided for delivering a pressurized fuel flow from the fuel source to the fuel distributor. A fuel flow pressure regulator is disposed in the fuel delivery system for controlling the pressure of the fuel flow delivered by the distributor to the injectors. An electronic sensing means is provided for determining when the ignition system of the engine delivers an electronic pulse to fire the spark plugs of the cylinders, and it produces an electronic signal in response thereto. A throttle potentiometer is provided for sensing the position of the throttle control and producing an electronic signal in response to the throttle position. A status sensing means is provided for measuring a combination of air temperature and engine temperature, and vacuum in the intake manifold and producing electronic signals representing the measurements. A control unit is provided for discriminating which plug is firing a fuel-air mixture charged cylinder and which electronically integrates the electronic signals from the throttle potentiometer, the electronic sensing means, and the status sensing means to generate an electronic signal which operates the fuel injectors at the proper time and for the calculated duration to deliver the correct volume of fuel to the cylinders of the engine for timed injection.

The present invention is designed to acquire the required timing information for providing the fuel injectors with their instructions by picking up an electronic pulse off the ignition system. While most fuel injection systems acquire the timing information from the electronic distributor, the problem that the present invention overcomes is how to determine which cylinder the spark is being distributed to fire a charged cylinder because of the staggered spark plug firing inherent to a V-twin engine. It would be easy if the timing could be picked off of dual points, but because the spark plugs both fire simultaneously, the unique electronics of the conversion system of the present invention provide the timing from an analysis of the spark plug firing pulses.

OBJECTS OF THE INVENTION

It is therefore an important object of the present invention to provide a fuel injection conversion system for V-twin motorcycle engines which converts them from carburetion to fuel injection.

It is another object of the present invention to provide a fuel injection conversion system for Harley-Davidson motorcycle engines which is able to time the fuel injection sequence from analysis of the spark pulses rather than from a mechanical electronic reading of the electro-mechanical or electronic-mechanical ignition timing unit which fires the spark plugs.

And it is a further object of the present invention to provide a fuel injection conversion system for Harley-Davidson motorcycles which will retrofit any V-twin motorcycle engine.

Other objects and advantages of the present invention will become apparent when the apparatus of the present invention is considered in conjunction with the accompanying drawings.

DESCRIPTION OF THE PREFERRED EMBODIMENT

Apparatus

Figure 1:
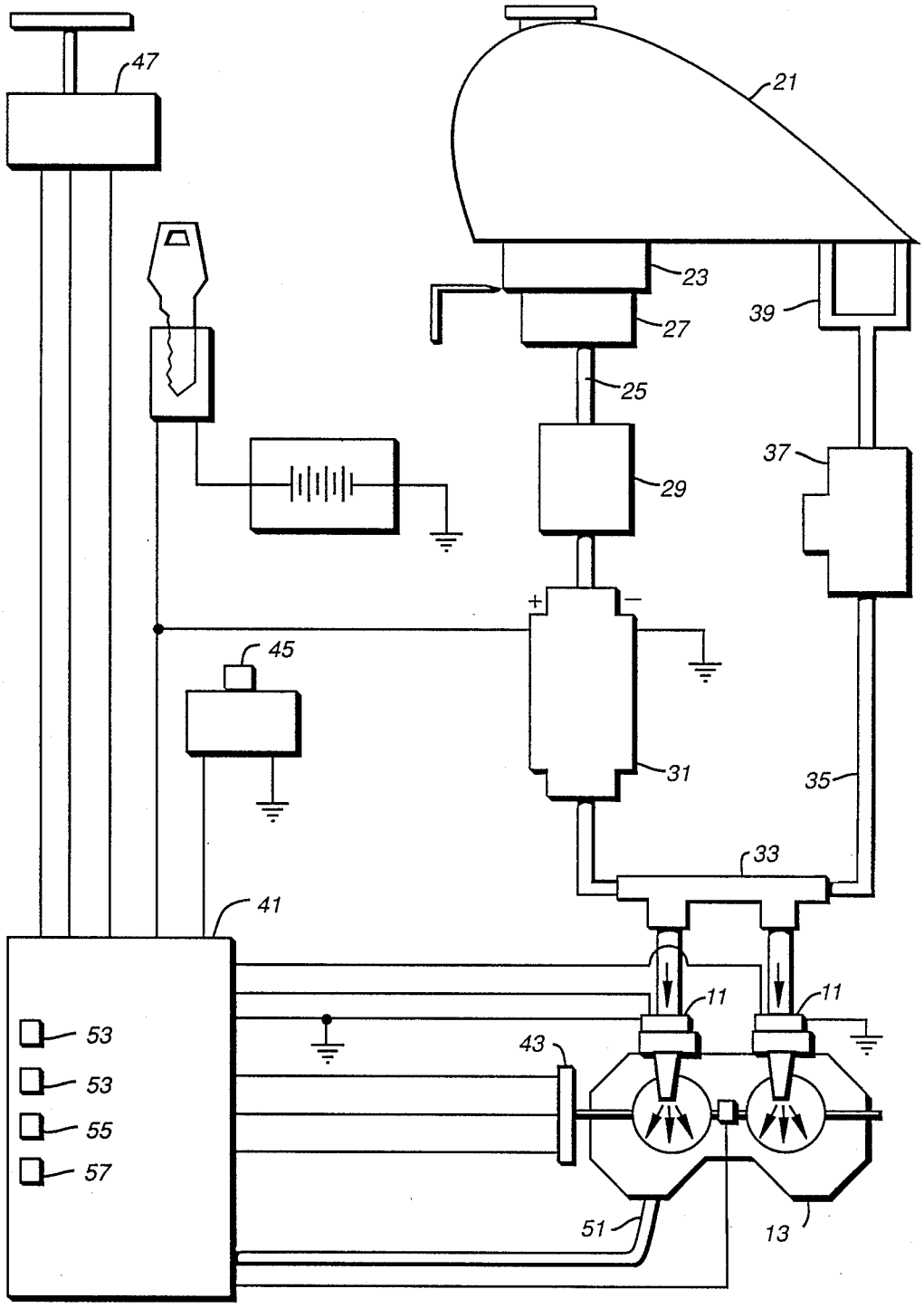
FIG. 1 is a schematic layout of the fuel injection conversion system of the present invention.
Figure 2A:
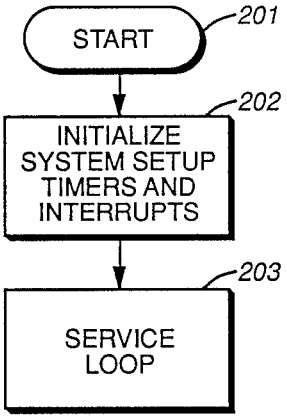
FIG. 2A is a firmware flow chart of the system initialization algorithm.
Figure 2B:
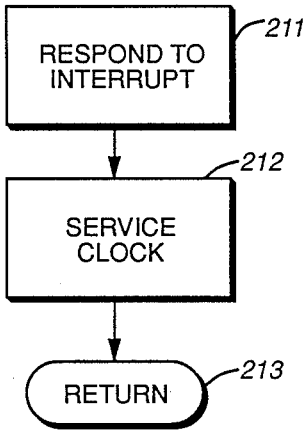
FIG. 2B is a firmware flow chart of the real time system clock algorithm.
Figure 2E:
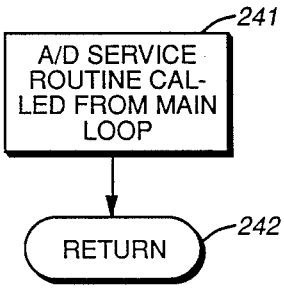
FIG. 2E is a firmware flow chart of the analog channel sampling and digitizing algorithm.
Figure 2C:
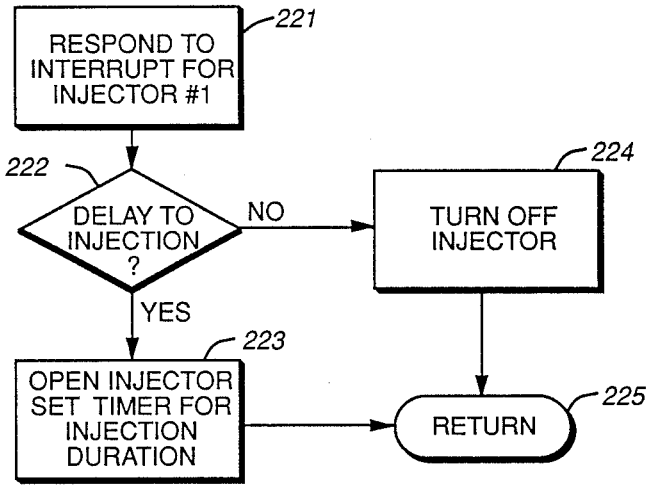
FIG. 2C is a firmware flow chart of the number 1 injector timer algorithm.
Figure 2D:
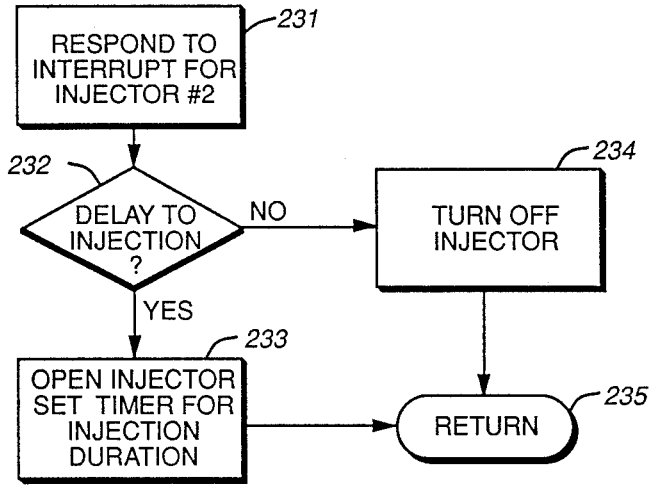
FIG. 2D is a firmware flow chart of the number 2 injector timer algorithm.
Figure 2F:
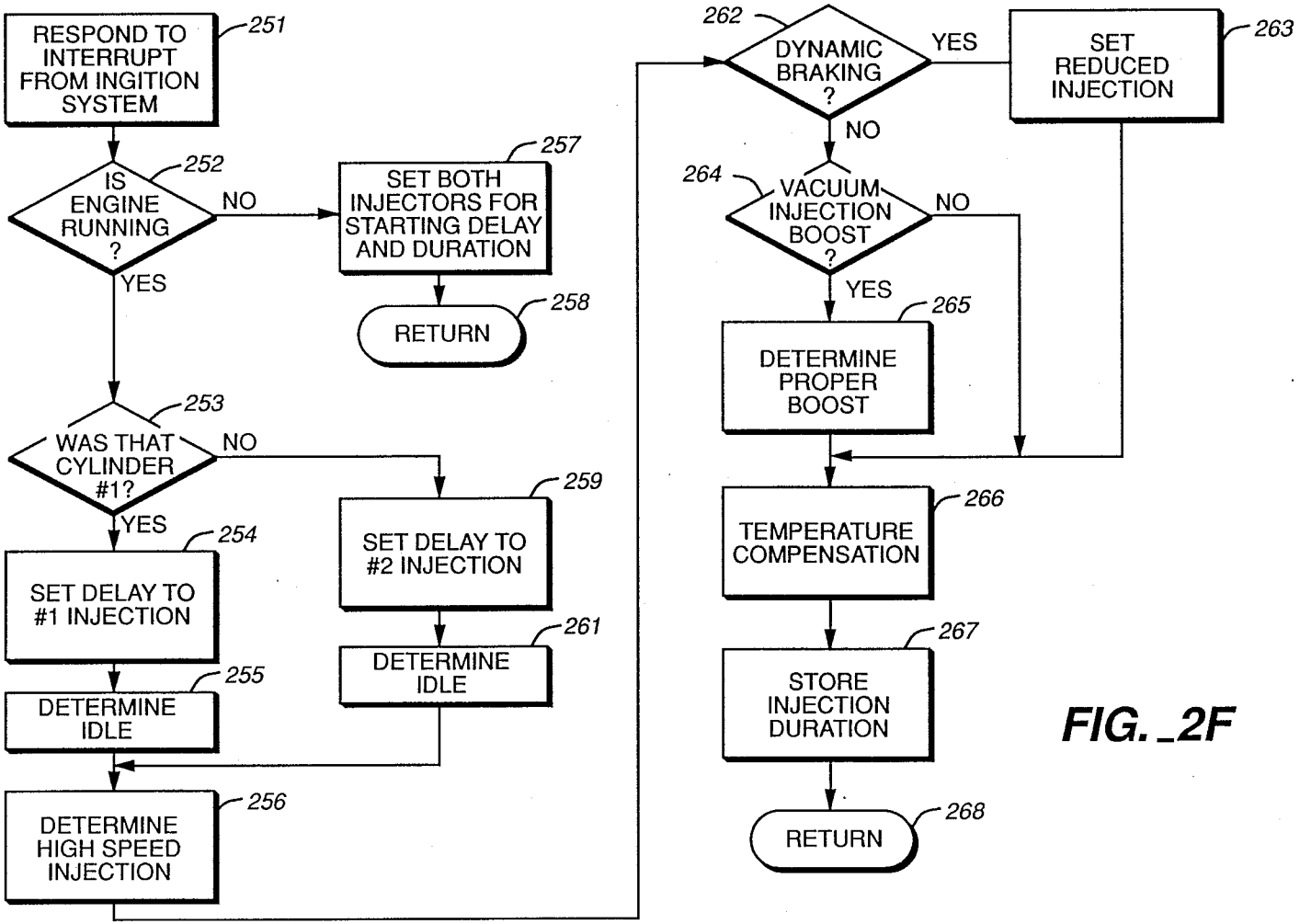
FIG. 2F is a firmware flow chart of the ignition timing sorting algorithm.
Figure 3:
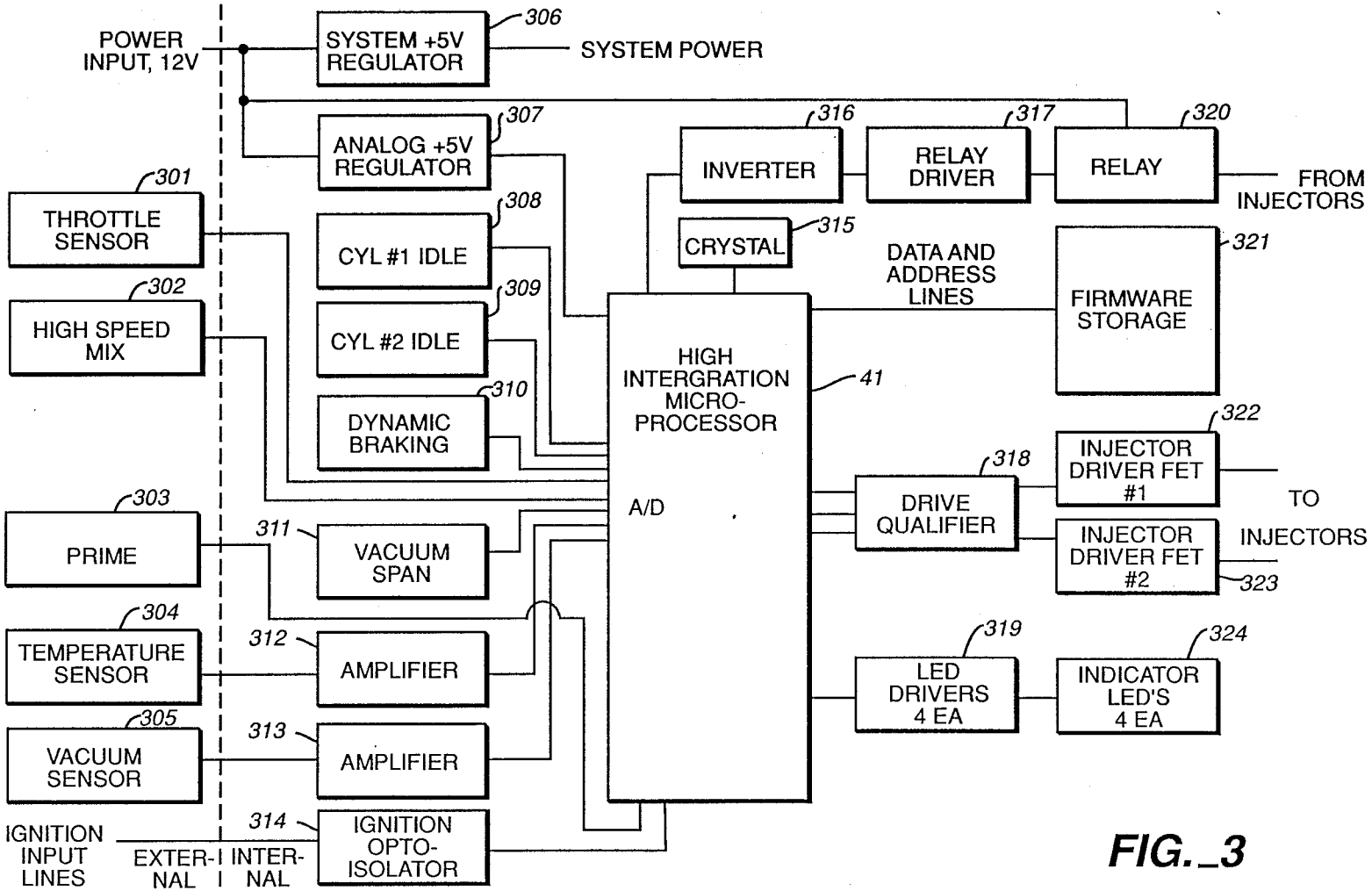
FIG. 3 is a block diagram of the fuel injection controller.
Figure 4:
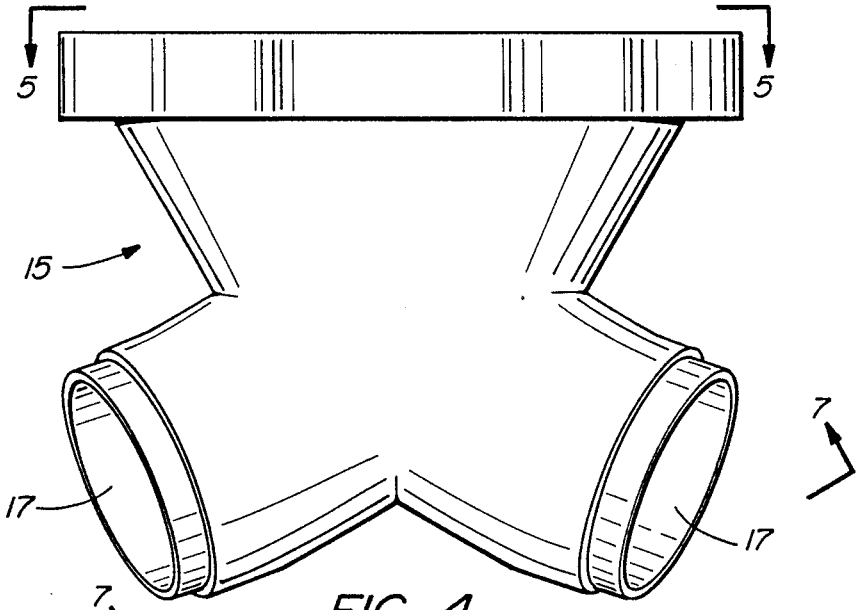
FIG. 4 is a top plan view of the intake manifold of the type used with the fuel injection system of the present invention.
Figure 5:
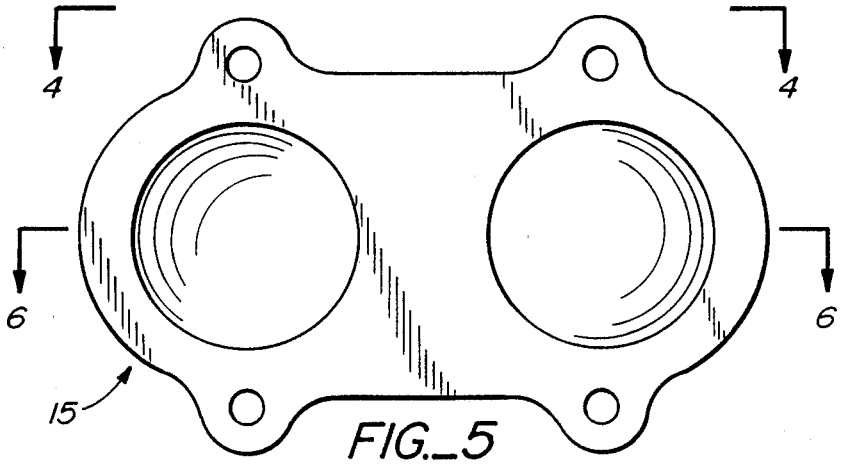
FIG. 5 is a front elevation of the intake manifold of FIG. 4 showing the mounting surface for the fuel injector throttle body.
Figure 8:
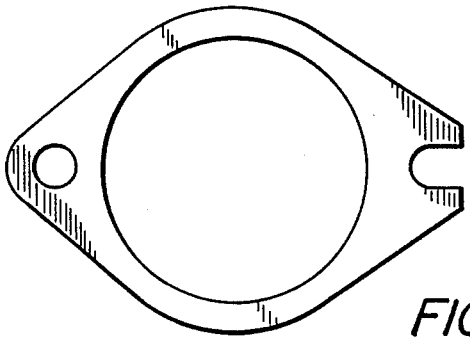
FIG. 8 is a top plan view of the clamping ring of FIG. 7.
Figure 6:
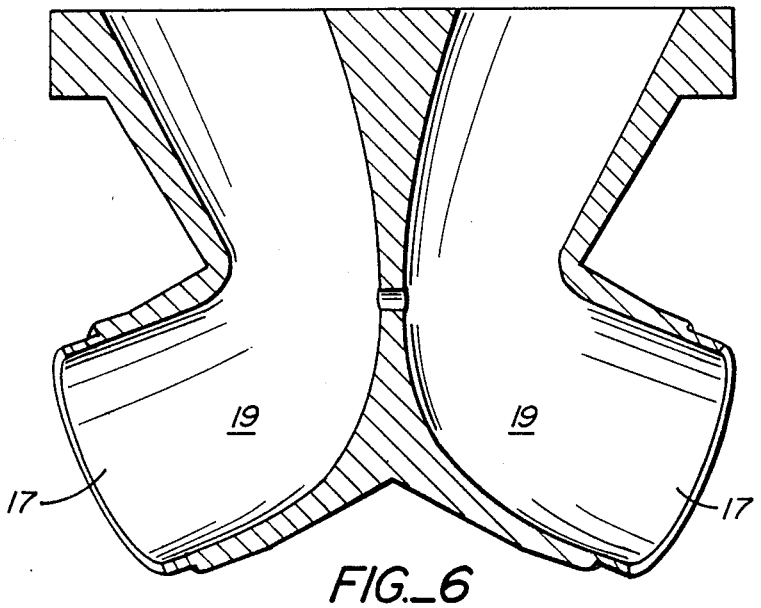
FIG. 6 is a top plan view in section showing the internal construction of the intake manifold of FIG. 4.
Figure 7:
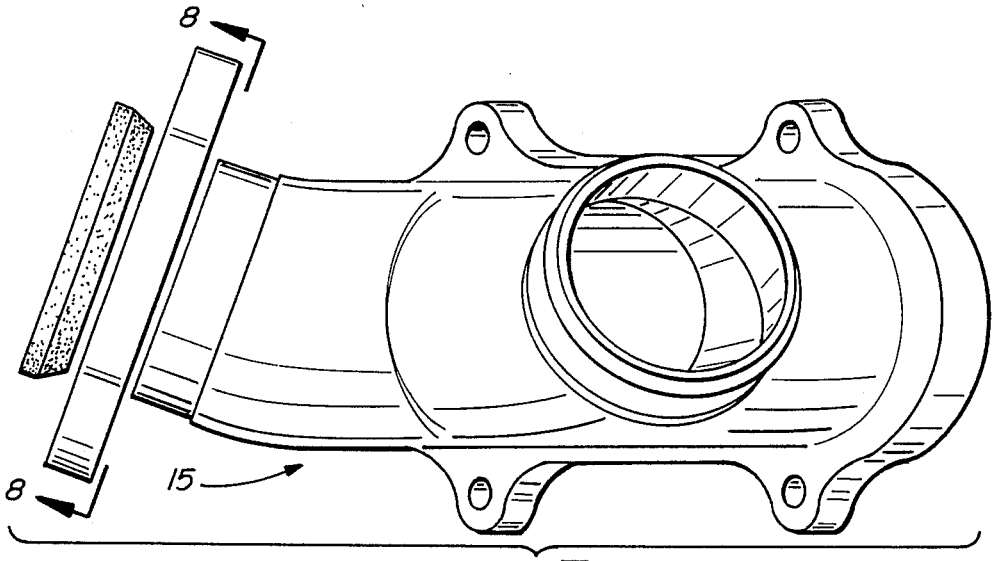
FIG. 7 is a perspective view of the intake manifold of FIG. 4 showing the clamping ring used to secure the manifold to an engine cylinder in side elevation.

Reference is made to the drawings for a description of the preferred embodiment of the present invention wherein like reference numbers represent like elements on corresponding views.

Harley-Davidson Special Problems

The fuel injection conversion system of the present invention will work for all reciprocating engines having V-twin cylinders but is specifically adapted for Harley-Davidson motorcycle engines. The Harley-Davidson engines are unusual in that the ignition systems fire both plugs simultaneously; there is no pulse steering with any sort of rotor or distributor mechanism. While one cylinder is firing with a compressed fuel charge, the other is finishing the exhaust stroke, and a plug firing at this time causes no interference. Thus, in order to adapt fuel injection to Harley engines, it is necessary to sort out the firing order because of the asymmetrical relationship between the cylinders and the constant firing ignition. This could be done with a cam and switch arrangement like a standard breaker ignition system. However, adding additional hardware to a cycle, such as the cam and switch arrangement, would probably be highly objectionable to most Harley owners. In addition, the differences between all of the models and types of ignition systems makes adding a cam and switch arrangement complicated, difficult, and essentially impractical. There are a large number of variables to compensate for and selecting the proper setup for any combination of factory and after-market parts requires a large list of selections and provides a great many chances for error. While a mechanical or electronic switch to identify the primary cylinder or to provide injection timing for both cylinders is simpler in theory, it is difficult in practice. The present invention provides a solution to these problems.

The present invention provides an electronic sensing means for determining when the ignition system of the engine delivers an electronic pulse to fire a charged engine cylinder by measuring the time between spark plug firings and using the asymmetrical relationship between the cylinders to sort out the order. The sensing means produces an electronic signal in response to the electronic pulses for the spark plugs, and that signal is integrated with other electronic signals, from other sensing means, in the control unit of the invention for controlling the timing and duration of the fuel injector operations.

Basic Elements

Fuel injectors 11 are mounted in a fuel injector throttle body 13 for delivering fuel from the injectors to the engine cylinders through the intake manifold 15. Since V-twin engines only have two cylinders, only two separate injectors are required. These fuel injectors are standard units and for the present invention can be the particular injectors made by Bosch which are utilized in Volkswagen flat four opposed cylinder air cooled engines.

The throttle body 13 is secured to the intake manifold 15 which in turn is secured to the cylinder heads proximate the intake valves of the engine. The unique configuration of the intake manifold includes the fact that it has separate intake tubes or ducts 17 for each injector 11 whereby there is no cross-over of fuel-air mixture between the two injectors and whereby accurate timed injection can be accomplished. Most fuel injection systems have fuel-air mixture intermixing because the injectors run continuously during high speed engine operation in those designs and allow the mixture to back up behind the intake valves when they are closed whereby equalization of air pressure (vacuum) is allowed to occur throughout the intake manifold for smooth engine operation. This standard solution to the problems of providing fuel injection for internal combustion engines is different from the preferred embodiment of the present invention wherein the more accurate and difficult result of timed as opposed to continuous injection is achieved throughout the range of operation of the engine. A small air communication passage approximately 3/16 inch in diameter is provided between the tubes in the septum 19 of the intake manifold of the present invention to equalize the pressure in the tubes for balance between the cylinders during engine operation without cross-over of the fuel-air mixture.

A fuel source, which is the fuel tank 21 of the motorcycle, is provided with an outlet 23 at the bottom thereof which delivers fuel to the fuel introduction system of the engine through a fuel line 25. The outlet is provided with a fuel shut-off in the form of a petcock 27 in the fuel line. A fuel filter 29 is provided to prevent particles from disabling the jets in the fuel injectors 11.

The fuel delivery line 25 is provided with a fuel pump 31 which is electrically driven for delivering a pressurized fuel flow to a fuel distributor 33 in the form of a fuel rail which delivers an individual pressurized fuel flow to each of the injectors 11. A return fuel line 35 is provided for receiving unused fuel from the fuel distributor and returning it to the fuel source 21. The return flow fuel line includes a fuel flow pressure regulator 37 disposed downstream from the fuel distributor for equalizing fuel pressure in the distributor and controlling the pressure of the fuel flow delivered to the injectors. The return flow fuel line includes a fuel-T 39 and returns the fuel to the fuel source or tank. The fuel-T is used to feed the saddlebag-type fuel tank or the fuel can be returned through a vent tube at the top of the tank.

Electronic Sensing

There are three types of motorcycle ignition systems: Breaker, Electronic, and Magneto. Any one of these types may be in use on a Harley engine, and the solution to providing a conversion system requires the adaptability to determine fuel injector timing from any one of them. The present invention provides a solution to this problem as well as sorting out injector firing.

The first two types of ignition systems, Breaker and Electronic, operate similarly: an ignition coil is operated as a resonant transformer delivering very high voltage to the spark plugs. The Breaker ignition system uses a set of points to interrupt a current flow through the primary side of the coil while the "condenser" across the points and the inductance of the coil form a resonant circuit inducing very high voltage into the secondary winding. An Electronic ignition system will either replace the function of the points with a solid state device or charge a capacitor to several hundred volts and discharge it through the primary winding to generate the spark.

A Magneto ignition uses a rotating magnet to generate a constantly changing flux through a magnetic core. This constantly changing flux induces a current into any coil placed around the core. There are two windings on a Magneto core: one provides the high voltage to fire the plug while the other is used to control the time that the high voltage spark is generated. As long as the induced current is allowed to flow in this second control coil, it produces a magnetic field that cancels the changing flux. When this control coil current is interrupted, there is a very rapid flux increase inducing the high voltage into the first winding to provide spark for the plugs.

In the present invention, sensors are utilized to obtain a timing signal from the ignition system which is inputted to the control unit of the fuel injection system for utilization in controlling the operation of the fuel injectors. The Electronic ignition systems use sensors that may be optical (usually infrared), or magnetic (usually Hall effect devices). These sensors detect the windows cut in the sides of a metallic "cup" that is attached to the end of the cam shaft. Each window corresponds to a plug firing and the angle between the windows corresponds to the angle between the cylinders. The position of the lobes of a Breaker ignition system have a corresponding relationship. The output of the Electronic ignition system sensor is used directly by the control unit of the present invention. In the Breaker ignition system, the interruption of the current through the ignition coil by the points is sensed by the present invention to determine the firing point of the plugs. Either system can use the standard mechanical point setup or replace that with a solid state sensor. In Magneto ignition, the interruption of the control coil current flow is sensed. By changing jumper connections in the control unit of the present invention, the two ignition sensor input lines can be configured properly to accept any of the three types of ignition systems allowing for universal application.

The relationship of spark plug firing is fixed for any internal combustion engine based on its structural configuration. The Harley-Davidson "V" twin engine requires asymmetrical spark timing for the firing of the plugs. The time lapse between firing of cylinders #1 and #2 is different from the time lapse between #2 and #1. This asymmetry allows the determination of #1 cylinder by comparing the two time periods. The timing relationships between the cylinders is 4/9 for #1 to #2 and 5/9 for the reverse. The 4/9, 5/9 timing relationship is determined by the angle between the cylinders and that angle does not change model to model. Any "V" engine will have this asymmetry, the degree of which is a function of the angle between the cylinders, and the same analysis will work for all configurations.

Once the engine has been started, and synchronization of fuel injector firing has been achieved, as will be explained, a simple alternating fuel injector actuation pattern suffices except for the chance of losing sync and being unable to regain it unless the engine is shut down which is an unacceptable situation, so the present invention is designed to specifically prevent that occurrence. Spark timing advance is handled by the ignition system, and the timing advance is anticipated by the program controlling the fuel injection system. By constantly checking each cylinder firing for being in sync, any problems are immediately corrected. A method of checking for sync only periodically would be a compromise, but any recovery time would then be determined by the spacing time between synchronization checks which is not as good as constant checking.

Apparatus and Environment Sensing

Status sensing means are provided for measuring a combination of air temperature and engine temperature, vacuum in the intake manifold, and for producing electronic signals in response thereto which are also delivered to the control unit 41.

The temperature sensor is a thermistor 49 located between the injectors in the throttle body in the air flow to both injectors. Integration of air temperature and engine temperature is achieved by placement of the measuring device in the air intake chamber but with a resulting thermal path to the cylinders through the throttle body. This generates a signal that is the integration of the usual separate measurements of air temperature and engine temperature. It is simpler to generate this integrated signal than to independently measure and then integrate them.

The throttle position, temperature, and vacuum sensors are commercially available units which produce analog signals for the control unit 41 which allows selection of the degree of accuracy of measurement desired based on the choice of firmware. A high resolution of the throttle position is required in comparison with the vacuum information which can be of a courser nature or less accurate measurement.

A throttle potentiometer 43 is provided for sensing the position of the throttle in the injector/throttle body 13 and producing an electronic signal in response thereto which indicates how much air is flowing into each cylinder. The throttle position sensor also indicates when the throttle is closed which indicates or is defined as the downhill or deceleration or idle condition.

The intake manifold vacuum is measured to determine the load on the engine during low speed acceleration and is used to calculate the proper injection enrichment of the air-fuel mix needed to produce the power demanded for extreme conditions.

Most of the electronic signals used by the control unit 41 of the present system are analog; only the signal from engine prime button and from the ignition timing are digital.

System Operating Parameters

The prime, cold start, or choke button 45 provides a signal to the control unit which in turn actuates the fuel injectors 11. The system, in the case of engine prime and ignition timing, is looking for an event in time; not making a quantitative measurement, so analog information is not needed. During prime of the engine, the injectors are enriched a percentage of fuel flow whereas other fuel injection systems utilize separate injectors that shut off after the engine heats up and trips a thermally activated switch.

The signal input line from the cold start or prime button to the control unit is filtered and current limited so that if that line shorts to any other wire on the cycle the electronics will not be damaged. The ignition input signal is opto-isolated for noise immunity and isolation because of the high voltages generated by the three ignition systems primaries which provide the input signals to the control unit of the present invention. The ignition signal is used as an input for timing and speed measurements. There are also noise problems from ground loops with all three ignitions. Opto-Isolation is used to break these ground loops and to provide electrical isolation from these high voltages up to 350 volts.

There are several set points in the system and their magnitude is adjustable but their relationship to each other is fixed in the firmware. Engine speed (RPM) is used as a qualifier for detection of dynamic braking, removal of injection enrichment, and defining the difference between a running engine and a starting engine. Other quantitative steps are the percentage of enrichment during acceleration for each step of the vacuum span. The range of detection of the vacuum sensor is divided into areas, referred to as steps. The actual span of these steps is controlled by an adjustment referred to as vacuum span, and can cover from 0 to a minimum of 0.25 to a maximum of 15 inches of mercury vacuum. As long as the manifold vacuum is above the top step of the selected span, the engine is defined as needing no additional enrichment due to load. Above 2,000 RPM, there is also no vacuum defined enrichment.

There are five operational setup adjustments which can be manually set by the machine operator through controls on the control unit: injection for #1 cylinder idle; injection for #2 cylinder idle; percentage of idle injection for dynamic braking (also called deceleration or downhill) covering the range of 0 to 50% of idle injection; vacuum scale to control the vacuum range for which fuel enrichment is desired; and throttle scale.

There are several ways that the idle injection value can be derived, a look-up table is only one way and the choice of method is a programmer's prerogative. The range available covers the span from the leanest possible fuel injection condition to the richest needed for the large displacement engines.

The engine deceleration injection covers a range of 1 to 100 percent of a cylinder's idle injection but for practicability is limited by manual control from 0 to 50 percent. Engine deceleration is defined as a closed throttle and engine RPM higher than the idle range specified by the engine manufacturer (800–900 RPM).

The throttle scale control, which is the high speed mixture control 47, is used to compensate for the different cylinder displacements, cam shaft durations, exhaust efficiencies, and other engine variables. It provides the means to give the system a user adjustable variable to dynamically set the operational air-fuel ratio for any cylinder size/ cam combination. The system uses the reading from the throttle scale to magnify the injection time derived from the throttle position sensor. Other types of electronic fuel injection control utilize computer chips which are preprogrammed for the fuel required to operate the specific engine while the present invention has a wide degree of variable adjustment to provide a truly universal fuel injection conversion system for all models and engine sizes of all V-twin engines simply by providing different intake manifolds.

The control system uses several software setable timers, digital input and output ports, and an analog to digital converter. Instead of using individual sub-systems, a highly integrated micro-processor combines all of these functions into a single chip for a simpler and more compact construction. The A/D system has eight channels and converts the analog voltages/information into digital format for processing. This allows user selected variables to be selected by a potentiometer and for quantitative measurements to be made. The input and output ports are the digital information and control lines for sensing digital conditions and controlling digital devices.

The electronic control unit integrates the electronic signals from the throttle potentiometer, the electronic sensing means, and the status sensing means, to generate an electronic timing and duration signal which tells the fuel injectors when and how much fuel to deliver to the cylinders through the injector body.

Timing

Three timers are utilized for counting engine revolutions and tracking the time from plug firing to injection time and duration. One counter is dedicated to RPM timing or engine speed, and two are utilized for delay for injection point timing and subsequent injection duration timing: one for each cylinder controlling the wait and injection duration times for that cylinder. The wait time is calculated and put into that cylinders' timer and then the injection duration is calculated and stored for subsequent use by that timer. The program keeps track of the sequence of events for each cylinders' timer. Two are needed because the injection for the two cylinders can overlap in time, so individual timers are utilized for each cylinder. In a more hardware intensive design, as few as four timers would be needed although five would be more direct. RPM timing determines the cylinder firing relationship and engine speed information.

The only problem is rapid acceleration or deceleration of approximately 20,000 degrees per second/per second which is beyond the capabilities of the system. This corresponds to an acceleration from 500 RPM to 6000 RPM in 1.65 seconds. The engine can accelerate at and above this rate and provision has been made to accommodate this discrepancy in the following manner. Once synchronization of the injectors with the firing order has been achieved, any error caused by rapid acceleration or deceleration will be ignored during these extremes and an alternating pattern is used to select which cylinder is to be injected. The electronics are synchronized when the predicted and the measured firing cylinder match and the engine speed is slow enough to allow the calculations of the wait to injection time and the injection duration. The "wait time" is derived from the rotational speed and the injection duration is derived from the throttle position engine RPM and manifold vacuum information. The electronics can respond and process data fast enough to handle engine speeds of up to 48000 RPM. Measurement errors can be induced by faulty ignition systems and intermittent electrical connections on the motorcycle. These conditions are not that unusual and the firmware is designed to accommodate these problems as follows.

The ignition sensing input lines are filtered and the firmware ignores any change on these lines for a period of time that is dependent upon the engine speed after the first recognized trigger point. This closes the window of error that can possibly be generated by loose mechanical parts in the engine timing assembly. The analog input lines are also filtered and standard digital sampling and averaging techniques are used to remove or minimize errors.

There are five timing measurements made by the three timers: engine rotational duration, time from spark to start of injection for each cylinder, and injection duration for each cylinder. Under heavy load/acceleration conditions, the injection duration is longer than the time that the intake valve is open and can stretch out to overlap the other cylinders' injection time. In a pure hardware environment, there would be an engine RPM timer, two timers for injection duration and one timer that would be used for the wait to inject timer. The control circuitry would be much simpler if there were two wait timers instead of having one timer do double duty. There is extreme difficulty in accomplishing effective control of an injection system without using a microprocessor.

System Protection

Safety for the injector system of the present invention is concerned with avoiding a malfunction of the injectors or losing control of the engine operation. Due to the nature of motorcycles, electrical connections can become intermittent and power supply voltages can have spikes on them that are excessive or are below the normal range. Polarity protection/decoupling diodes are used on the power input to block negative spikes on the power line, and a capacitor on the cathode of the diode supplies the system operational current during brief power voltage drops caused by intermittent and engine starter operation. This is for noise immunity and improved operation in a marginal situation. The capacitor is of sufficient size to run the electronics for approximately one-half second in case there is a power interruption. Additionally, a safety relay must be energized to supply power to the injectors. The injector firing safety relay involves the use of an inverted qualifying line to allow injector operation. This precludes operation of the injectors during power up (start) and power down times (stop).

Digital control lines are utilized to activate the injectors, sense plug firing, respond to the cold start or prime button, and activate the injector safety relay. Digital control lines are defined as having only two possible recognized states: high and low. This on or off condition is immune to noises that would interfere with analog lines since the system is not concerned with a quantitative state but only a relative condition. When power is first applied to the system, the processor in the control unit goes through a start-up procedure and during this time the processor's digital control output lines are all in the "high" state. By requiring some control lines to be "low" for injector operation, the system makes it impossible to falsely operate the injectors until the processor has finished its preliminary operations and has taken control of the system.

If external electrical noise is induced into the digital control system (the processor and memory system), the program steps could get out of sequence if the addressing is affected or the wrong decision could be made if data is interfered with. Either of these will result in the wrong function. Generally, addressing problems are termed hard failures (not easily detected or recovered from) while data errors are termed soft failures in that the data could be corrected with a more recent measurement and that the correct decision would be made the next time. Therefore, a watch-dog timer is used to detect a "lost" program execution sequence when the timer is not reset by the firmware. When the timer times out, it causes a system reset to occur.

The injector safety relay removes power from the injectors if the watch-dog timer times out. A watch-dog timer is a device/circuit that must have a specific operation constantly actuated and each operation must be completed within a specified time, otherwise the device/ circuit will cause the system to shut off or reset as desired. In the present invention, the lack of service to the watch-dog circuit, which is built into the 80C552 processor, causes a system reset after which the unit will start operation again. That process will take a brief time and the controller should be resynchronized within 1.5 revolutions. This is a safety feature; in case the firmware gets out of sequence, the system will reset itself.

Electronics

A high integration microprocessor is utilized for the control unit, namely a 80C552 from Signetics. By combining the control of the several functions into one electronic chip, a significant space savings is achieved. This chip has a built-in analog section with a 10-bit A/D and two D/As of 8-bit accuracy.

Field Effect Transistors (FETs) are used to switch the current that operates the fuel injectors on and off. FETs are used because they are the best devices for handling an inductive load and need the minimum support circuitry: they are the simplest way to drive an inductive load which is what the injectors represent. These are commercially available discrete devices external to the processor but part of the electronics package. Bipolar devices could be used but require more support devices and components.

The control unit of the fuel injection conversion system is also provided with manually adjustable controls for the five operational setup adjustments. The controls include separate idle mixture adjustments 53 for each injector. The control unit also includes a manually adjustable high speed mixture control called the throttle scale control 47 which is a separate potentiometer that adjusts a whole range of injection like changing a jet size. It is used to set the proper correction factor to be used with the throttle position sensor to control the duration of the injection for proper fuel mix. These adjustments determine how long the injectors are held open. Separate manual controls are also provided on the control unit to set the percentage of idle mixture for dynamic braking 55 and vacuum adjustment 57.

In all other injection systems, parameters such as dynamic braking injection, acceleration air/fuel mix, are fixed in firmware. This requires a specific firmware package for each possible engine component arrangement. The present invention alleviates that problem by allowing the user to set the air/fuel mixture thereby allowing the unit to be used on an extremely wide range of engine component combinations. During acceleration, the fuel mix is set for best power, in the area of 12:1. This actual figure varies with each engine. In a "cruise" condition, the fuel mix is reduced to approximately 16:1 for good economy. This reduction is a fixed percentage of the high speed setting, which applies to all engines.

The fuel injection conversion system is actuated by a battery which is controlled by an ignition switch and provides power to the fuel pump, the control unit, and the fuel injectors.

LEDs mounted on the control unit are used to indicate cylinder injections, system operation, and crank shaft synchronization. These can be variably mounted and show that the electronics are working.

Operation and Sequence

When power is first applied to the system, the microprocessor in the control unit is held in a reset state by hardware for approximately one-half second. In this state, all input/output lines are held at high output and the inverter qualifier disables drive to the FETs in this situation. A reset condition only needs a 0.5 microsecond to be established. Since the dropout time for a relay is several milliseconds, it is not quick enough to prevent operation of the injectors. A reset condition also removes drive from the injector safety relay.

The safety relay must be energized (on) to supply power to the injectors. When power is first applied to the unit it will be approximately one-half second before the processor has actually started operation and during this time the drivers for the injectors could be on. The relay prevents the operation of the injectors during this and similar times. During a reset condition induced by the watch-dog timer, the AND gate safety is relied upon to remove drive to the FETs. If the error condition is such that the AND gate safety does not work, the duration of this error condition would be quite short, 20–30 microseconds, which is too short for the injectors to mechanically open.

Until proper firing order is determined, the system fires both injectors at the same time making starting more dependable or faster. The spark firing is asymmetrical, and an engine timer in the control unit microprocessor measures the time duration between the spark firings, and the processor stores the times for comparison to determine the longer and shorter time periods. By comparing the differences, the sequence of cylinder charging is determined by the processor and thereby the injector sequence. The processor then synchronizes the individual injector timing as a result of identifying the cylinder charging sequence from the measurement of the different time durations between the asymmetrical spark firings.

Once synchronization is obtained, the system follows the proper sequential injector timing. A separate timer is utilized for each cylinder, thereby simplifying operations. As each cylinder fires, the time to that cylinder's injection instant is calculated, minus the two millisecond injector delay, and its timer is set accordingly. The duration of injection is stored for later use by the computer. When that timer times out, the injector is opened to commence injection and the timer is then set with the stored duration of injection, and at the end of that time, the injector is closed. When a digital timer "times out," it has reached its terminal count, either a specific condition such as all zeros or a match with a stored count value.

By updating engine speed data every crank revolution, and not having the engine timer set for more than 390 degrees of crank revolutions, errors from rapid acceleration and deceleration are reduced. The duration of the last two crank revolutions are saved in computer memory and constantly updated. They are compared by the processor to determine the firing sequence and are used to determine the speed of rotation. Due to the asymmetry between the cam lobes due to the 44 degree angle between the cylinders, the injector timing shifts with engine speed. Because of the two millisecond opening time for the injectors and the decreasing time from firing to desired injection time, the desired injection time for cylinder #2 shifts to before the firing of cylinder #1 at engine speeds greater than 3500 RPM.

By setting the timers from each cylinder firing to the cylinder's injection time, it is possible to obtain reliable operation up to the speed where the injectors cannot supply enough fuel during the time that the intake valve is open.

Conclusion

It will be apparent from the foregoing description of the invention, in its preferred form, that it will fulfill all the objects and advantages attributable thereto. While it is illustrated and described in considerable detail, the invention is not to be limited to such details as have been set forth except as may been necessitated by the appended claims.

We claim:

1. A fuel injection conversion system for V-twin motorcycle engines having two cylinders, an ignition system, and a fuel source, comprising
   - an intake manifold providing separate ducts for delivering a fuel and air mixture separately to each cylinder,
   - a pair of fuel injectors mounted in a fuel injector and throttle body secured to said intake manifold,
   - a fuel distributor for delivering an individual pressurized fuel flow to each of said injectors,
   - a fuel pump for delivering a pressurized fuel flow from the fuel source to the fuel distributor,
   - a fuel flow pressure regulator for controlling the pressure of the fuel flow delivered by the distributor to said injectors,
   - an electronic sensing means for determining when the ignition system of the engine delivers an electronic pulse to fire each spark plug of the cylinders and producing an electronic signal in response thereto,
   - a throttle potentiometer for sensing the position of the throttle and producing an electronic signal in response thereto,
   - a status sensing means for measuring a combination of air intake and engine temperature, and vacuum in the intake manifold and producing electronic signals therefrom, and
   - a control unit which discriminates which spark plug of the engine is firing a fuel-air mixture charged cylinder of the engine from the asymmetrical spark plug firing order related electronic signal from said electronic sensing means, said control unit electronically integrating the electronic signals from the throttle potentiometer, the electronic sensing means, and the status sensing means to generate electronic signals which control the fuel injectors and operate them at the proper time and for the calculated duration to deliver the proper amount of fuel to said cylinders for the engine operating conditions by timed injection.

2. The fuel injection conversion system of claim 1 wherein said control unit includes manually adjustable idle mixture controls for each cylinder injector.

3. The fuel injection conversion system of claim 1 wherein said control unit includes a manually adjustable high speed mixture control (throttle scale control).

4. The fuel injection conversion system of claim 1 wherein said control unit includes a manually adjustable vacuum scale control.

5. The fuel injection conversion system of claim 1 wherein said control unit includes a manually adjustable control for percentage of idle injection to 50 percent thereof for dynamic braking.

6. The fuel injection conversion system of claim 1 including a return fuel line for returning unused fuel from the fuel distributor to the fuel source.

7. The fuel injection conversion system of claim 1 wherein the control unit utilizes three separate timers for counting engine revolutions and tracking the time from plug firing to injection time and duration thereof for providing timed injections, one of said timers being dedicated to engine speed timing, and two being utilized one per injector for delay for injection point timing and subsequent injection duration timing.

8. The fuel injection conversion system of claim 1 wherein the control unit is provided with safety features including a power input diode to block negative power spikes and a capacitor on the cathode of the diode to supply operational current to the system during brief power voltage drops.

9. The fuel injection conversion system of claim 1 wherein the system includes a safety relay which must be energized to supply power to the injectors, said safety relay being controlled by a watch-dog timer which causes a system reset in the event it times out due to a malfunction in the system sequence of operation.

10. The fuel injection conversion system of claim 9 wherein the system is provided with digital control lines to activate the sensors, sense plug firing, respond to the prime button, and activate the safety relay.

11. The fuel injection conversion system of claim 1 wherein field effect transistors are utilized to switch the current that operates the fuel injectors.

12. The fuel injection conversion system of claim 1 wherein the control unit thereof utilizes a 80C552 high integration microprocessor by Signetics.

13. A fuel injection conversion system for V-twin motorcycle engines having two cylinders, an ignition system, and a fuel source, comprising an intake manifold providing separate ducts for delivering a fuel and air mixture separately to each cylinder, a pair of fuel injectors mounted in a fuel injector and throttle body secured to said intake manifold, a fuel distributor for delivering an individual pressurized fuel flow to each of said injectors, a fuel pump for delivering a pressurized fuel flow from the fuel source to the fuel distributor, a fuel flow pressure regulator for controlling the pressure of the fuel flow delivered by the distributor to said injectors, a return fuel line for returning unused fuel from the fuel distributor to the fuel source, an electronic sensing means for determining when the ignition system of the engine delivers an electronic pulse to fire each spark plug of the cylinders and producing an electronic signal in response thereto, a throttle potentiometer for sensing the position of the throttle and producing an electronic signal in response thereto, a status sensing means for measuring a combination of air intake and engine temperature, and vacuum in the intake manifold and producing electronic signals therefrom, a control unit which discriminates which spark plug of the engine is firing a fuel-air mixture charged cylinder of the engine from the asymmetrical spark plug firing order related electronic signal from said electronic sensing means and which electronically integrates the electronic signals from the throttle potentiometer, the electronic sensing means, and the status sensing means to generate electronic signals which control the fuel injectors and operate them at the proper time and for the calculated duration to deliver the proper amount of fuel to said cylinders for the engine operating conditions by timed injection, said control unit including manually adjustable idle mixture controls for each cylinder injector, a manually adjustable high speed mixture control, a manually adjustable vacuum scale control, and a manually adjustable control for percentage of idle injection to 50 percent thereof for dynamic braking, said control unit utilizing three separate timers for counting engine revolutions and tracking the time from plug firing to injection time and duration thereof for providing timed injections, one of said timers being dedicated to engine speed timing, and two being utilized one per injector for delay for injection point timing and subsequent injection duration timing, said control unit including a power input diode to block negative power spikes and a capacitor on the cathode of the diode to supply operational current to the system during brief power voltage drops, a safety relay which must be energized to supply power to the injectors and controlled by a watch-dog timer which causes a system reset in the event it times out due to a malfunction in the system sequence of operation, digital control lines to activate the sensors, sense plug firing, respond to the prime button, and activate the safety relay, and field effect transistors to switch the current that operates the fuel injectors.

* * * * *